US007412850B2

(12) United States Patent
Yamano

(10) Patent No.: US 7,412,850 B2
(45) Date of Patent: Aug. 19, 2008

(54) COMPLEX CAM SYSTEM

(75) Inventor: Hirotoshi Yamano, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 11/794,109

(22) PCT Filed: Dec. 26, 2005

(86) PCT No.: PCT/JP2005/023817

§ 371 (c)(1),
(2), (4) Date: Jun. 25, 2007

(87) PCT Pub. No.: WO2006/070762

PCT Pub. Date: Jul. 6, 2006

(65) Prior Publication Data

US 2007/0289338 A1 Dec. 20, 2007

(30) Foreign Application Priority Data

Dec. 27, 2004 (JP) ..... 2004-377693

(51) Int. Cl.
*D04B 15/32* (2006.01)

(52) U.S. Cl. ..... 66/78

(58) Field of Classification Search ..... 66/75.1, 66/78, 71, 76, 77
See application file for complete search history.

(56) References Cited

U.S. PATENT DOCUMENTS 4,474,037 A 10/1984 Kühnert
4,545,219 A 10/1985 Schmodde
4,616,488 A 10/1986 Schmodde
4,643,003 A * 2/1987 Schmodde ..... 66/78
4,718,255 A * 1/1988 Grussel et al. ..... 66/78
4,729,230 A 3/1988 Schmodde et al.
5,305,619 A 4/1994 Shima et al.
5,343,719 A * 9/1994 Nakamori et al. ..... 66/75.1
5,367,892 A 11/1994 Shima et al.
6,125,661 A 10/2000 Shima

FOREIGN PATENT DOCUMENTS

JP 62-19535 4/1987
JP 62-104946 5/1987
JP 2-10262 3/1990
JP 6-84583 10/1994
JP 7-42639 5/1995
JP 2814234 10/1998
JP 3292836 6/2002

* cited by examiner

*Primary Examiner*—Danny Worrell
(74) *Attorney, Agent, or Firm*—Harness, Dickey & Pierce, P.L.C.

(57) ABSTRACT

A complex cam system capable of using a compound needle as a knitting needle is disclosed. In one embodiment of the present invention, a needle raising cam, a transfer cam, and knitting cams act on a butt provided in a needle body of the compound needle. A slider cam acts on a butt provided in a slider of the compound needle. Guide paths in transfer for the needle body and the butt of the slider are constituted with delivering paths and receiving paths, and switched from knitting paths. In the delivering paths, a transfer operation by the compound needle can be carried out smoothly using two knobs in a three knobby-shaped paths.

8 Claims, 9 Drawing Sheets

COMPLEX CAM SYSTEM

TECHNICAL FIELD

The present invention relates to a complex cam system which is mounted on a carriage of a weft knitting machine and is capable of making the weft knitting machine carrying out operations for knitting a knitted fabric including basic operations of knit, tuck and miss, and an operation for transfer.

BACKGROUND ART

Conventionally, in a weft knitting machine in which front and rear needle beds are opposed to each other at a needle bed gap, there has been used a complex cam system having a transfer cam which is capable of carrying out an operation for knitting a knitted fabric, and a transfer operation in which delivering and receiving of a knitted loop are carried out between the front and rear needle beds. In a conventional complex cam system, a cam for a transfer operation is formed in an internal area of a needle raising cam for knitting a knitted fabric.

The applicant of the invention has disclosed a complex cam system in which a cam for delivering in the transfer operation is provided outside the needle raising cam (refer to Japanese Examined Patent Publication JP-B2 2-10262 (1990), for example). A latch needle is used as a knitting needle in JP-B2 2-10262. However, a blade for transfer is attached to a side of the knitting needle, and the knitting needle on a delivering side advances to a needle bed gap in such a state that a knitted loop to be transferred is held at a position at which the blade is provided. The knitting needle on a receiving side allows a hook to interpose between the blade and the knitting needle on a delivering side to receive the knitted loop. A transfer cam is provided on the needle bed gap side of the needle raising cam and the knitting needle is provided with two butts at an interval, to switch to a guide for a transfer operation during a guide by the needle raising cam for knitting a knitted fabric. A two knobby-shaped path which is most projected toward the needle bed gap at positions symmetric with respect to a center line passing through a tip of the needle raising cam are formed on the transfer cam as a path for guiding a butt of the knitting needle.

There has been also disclosed a cam holder of a weft knitting machine for guiding a needle body along a two knobby-shaped path by use of a latch needle to allow a delivering operation to carry out (refer to Japan Unexamined Patent Publication JP-A 62-104946 (1987), for example). In JP-A 62-104946, the needle body of a knitting needle is arranged to guide along a path having two knobby-shaped peaks across a center line, on a delivering side of a transfer operation. The knobby-shaped peak through which a butt passes first in association with movement of a carriage needs to precede a path to which the butt is guided by a needle raising cam for knitting, and the path of the butt is arranged to pass through outside a knitting cam, instead of between an inside of the knitting cam and the needle raising cam.

The applicant of the invention has also disclosed a needle manipulating cam for a weft knitting machine which includes a needle body and a slider, and attaches a blade for transfer to the needle body of a compound needle for opening and closing a hook of the needle body using the slider to allow a transfer operation (refer to Japan Examined Patent Publication JP-B2 6-84583 (1994), for example). In JP-B2 6-84583, a delivering operation of the needle body is carried out by a knitted loop delivering cam which is provided so as to project from a tip of a needle raising cam. The knitted loop delivering cam has its peak portion on a center line passing though a peak portion of the needle raising cam, and a butt of the needle body is guided so as to pass though one knobby-shaped path. In JP-B2 6-84583, in order to use the compound needle as a knitting needle to separately drive the needle body and the slider, a cam for driving a slider is provided at a position at which the transfer cam is provided in JP-B2 2-10262.

Conventionally, in a complex cam system for a compound needle, a downsizing of a carriage takes priority. Therefore, as shown in JP-B2 6-84583, a path which guides the butt of the needle body is arranged to be substantially similar to a path which guides to a knit position in a knitting operation. In the delivering of the transfer operation, it is necessary to advance the needle body closer to a needle bed gap than a knitting route in an operation for knitting a knitted fabric. Therefore, a cam having a triangular shape is added to a tip of the needle raising cam for knitting, so that a height of the needle body when advancing to the needle bed gap is further increased. When a delivering of a knitted loop is carried out using a knitting needle which is guided by such a knobby-shaped path, no slack is formed in the knitted loop, for example, at an end of a knitted fabric, when knitting a closed stitch in which a knitted loop is reduced or when knitting normally. Therefore, it becomes difficult that the hook of the knitting needle on a receiving side is introduced to the knitted loop which is held by the knitting needle in a knitted loop delivering side, and is further interposed to between the blade of the transfer and the knitting needle.

As disclosed in JP-A 62-104946, In a case in which the two knobby-shaped path is used for a delivery by the latch needle, the delivery is carried out, when a knitted loop is once pulled down at the first knob and then the needle body is once again projected toward a needle bed gap at the second knob and pulled down once again. Accordingly, a slack can be formed in the knitted loop, and thereby the hook of the knitting needle on a receiving side can be easily inserted to carry out the smooth transfer. However, in JP-A 62-104946, it is necessary to provide a guide path of the needle body for the delivering outside the knitting cam, thereby increasing a size of a cam which is mounted on the carriage as a whole.

DISCLOSURE OF INVENTION

An object of the invention is to provide a complex cam system which is capable of delivering at a timing of two knobby shapes so as to allow a stable transfer, and is capable of preventing a carriage from increasing in size.

The invention provides a complex cam system mounted on a carriage which reciprocatingly moves along a longitudinal direction of needle beds opposed to each other across a needle bed gap of a weft knitting machine, for reciprocatingly driving knitting needles disposed in each of the needle beds in a width direction of the needle beds so as to advance and retract the knitting needles and allowing the knitting needles to carry out an operation for forming a knitted loop, and as well to carry out an operation for transfer between the needle beds, comprising:

a needle raising cam for guiding a butt of the knitting needle along a path having a mountain-like shape portion symmetric with respect to a center line passing through a peak portion thereof and extending in the advancing and retracting direction of the knitting needle so that a hook of the knitting needle can advance to a knit position in the needle bed gap in both directions of reciprocating movement of the carriage; and a transfer cam in which mountain-like knobby-shaped paths for guiding the butt of the knitting needle are provided at a peak portion corresponding to the knit position of the needle raising cam, and on both sides of the peak portion, respectively, so that the hook of the knitting needle advances to a transfer position on a needle bed gap side closer than the knit position on the center line, wherein in a transfer operation, a guide path of the butt of the knitting needle on a knitted loop delivering side is shifted to the knobby-shaped path in a middle of the transfer cam while being raised by the needle raising cam, and is further guided so as to pass through the bump-shaped path on a downstream side of a moving direction of the carriage, and a guide path of the knitting needle on a knitted loop receiving side is guided so that the butt of the knitting needle on the knitted loop delivering side passes through the knobby-shaped path on a downstream side, and then the knitted loop locked by the knitting needle is received by the hook of the knitting needle on the knitted loop receiving side.

Further, in the invention, it is preferable that the knobby-shaped path in a middle of the transfer cam and the knobby-shaped paths provided on both sides of the knobby-shaped path in the middle of the transfer cam are disposed to be closer to the center line side closer than a knitting cam which guides along a path for pulling down the butt of the knitting needle from the needle bed gap so that the hook of the knitting needle is retracted from the needle bed gap in a knitting operation, and the guide path which guides the butt of the knitting needle on the knitted loop receiving side is also disposed to be closer to the center line side than the knitting cam.

Further, in the invention, it is preferable that the needle raising cam includes, in a mountain-like shape portion of the path, a step which becomes a path zone for keeping a state in which the knitting needle advances to a tuck position in the needle bed gap, and the knobby-shaped paths on both sides of the transfer cam are formed on a needle bed gap side of the step, and the switching mechanism carries out switching to the operation for the transfer by guiding the butt of the knitting needle from a state guided to the step along the path of the needle raising cam to the knobby-shaped path in the middle of the transfer cam.

Further, in the invention, it is preferable that the knitting needle is a compound needle which has a needle body having the hook at a tip thereof and a slider for opening and closing the hook, and the needle raising cam and the transfer cam guide the butt of the needle body, and the transfer cam system further comprises a slider cam for guiding a butt of the slider in three knobby-shaped paths having the same phase as the knobby-shaped path in the middle of the transfer cam and the knobby-shaped paths on both sides thereof.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
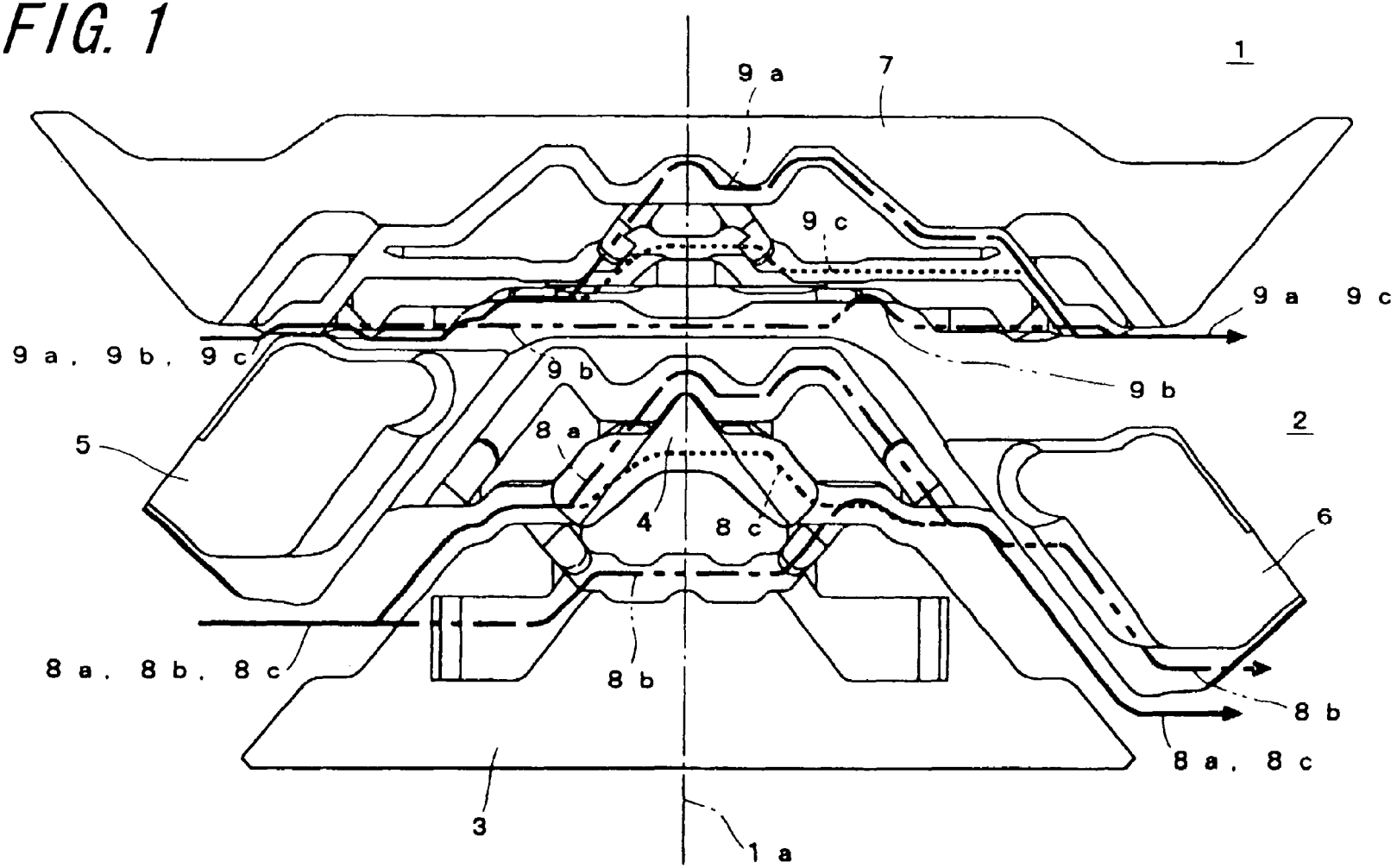
FIG. 1 is a plan view illustrating a schematic cam arrangement of a main part in a complex cam system 1 according to one embodiment of the invention.

Hereinafter, referring to the drawings, preferred embodiments of the invention will be described in detail.

FIG. 1 is a plan view illustrating a schematic cam arrangement of a main part in a complex cam system 1 according to one embodiment of the invention. The complex cam system 1 is mounted on a bottom plate 2 of carriages which are provided in front and rear needle beds opposed to each other across a needle bed gap in a weft knitting machine, respectively. The carriage reciprocatingly moves in a longitudinal direction of each needle bed, and selectively drives a knitting needle provided in each needle bed to allow a knitting operation and a transfer operation. Each needle bed of the weft knitting machine having a pair of needle beds in front and rear is inclined to have a mountain-like shape in a form of an inverted V viewed from a side so that a needle bed gap side is elevated. For convenience of description, a needle bed gap side is denoted as an upper side, and a side away from the needle bed gap is denoted as a lower side. A number of needle grooves are formed in the needle bed, and the knitting needle is stored in each needle groove, and the complex cam system 1 acts on each knitting needle to carry out an operation that a tip side of the knitting needle advances to the needle bed gap and retracts therefrom. Accordingly, knitting a knitted fabric and transferring are carried out in the needle bed gap. Each knitting needle is provided with a butt which is projected to an upper side from the needle groove. The bottom plate 2 of the carriage is provided on a bottom surface side of the carriage, and the complex cam system 1 acts on the butt of the knitting needle in an area through which the carriage passes. A cam, which is included in the complex cam system 1 in a projecting state from the bottom plate 2 to a lower side, forms a guide path of the butt, and a projecting amount from the carriage to the lower needle bed is described as a projecting amount from a surface of the bottom plate 2 to an upper side of a sheet surface.

In the complex cam system 1, a needle raising cam 3, a transfer cam 4, and knitting cams 5 and 6 are included. The needle raising cam 3 of a substantially mountain-like shape, and a center line 1*a* of the complex cam system 1 is parallel to a direction that the knitting needle advances to the needle bed gap and retracts therefrom. The carriage is capable of reciprocatingly moving in a direction perpendicular to the center line 1*a*. The transfer cam 4 is a projection and retraction type. The knitting cams 5 and 6 are provided on both sides of the needle raising cam 3. The needle raising cam 3 guides the butt of the knitting needle to advance the hook of the knitting needle to the needle bed gap. The knitting needle which has advanced to the needle bed gap in the knitting operation of the knitting needle is pulled down since the knitting cams 5 and 6 on a downstream side of the needle raising cam 3 act on the butt. FIG. 1 shows a state in which the carriage moves to a left side, and the knitting cam 6 on a right side of the needle raising cam 3 acts on the butt of the knitting needle. The knitting cams 5 and 6 have an inclined surface which guides the butt to a lower side, and are capable of moving in a direction parallel to the inclined surface. When the knitting cams 5 and 6 move to a lower side, stitch density of a formed knitted loop can be increased.

A compound needle can be used as the knitting needle for the complex can system 1. The needle raising cam 3, the transfer cam 4, and the knitting cams 5 and 6 act on the butts which are provided on a needle body of the compound needle. A slider cam 7 acts on a butt which is provided on a slider of the compound needle. A guide path 8 in transfer to the butt of the needle body is configured with a delivering path 8*a* and a receiving path 8*b*, and is switched from a knitting path 8*c*. The knitting path 8*c* is used when the transfer cam 4 is switched to retraction. The knitting path 8*c* is provided for knit, and paths for tuck and miss are also provided. However, the description is omitted as a well-known matter. A delivering path 9*a*, a receiving path 9*b*, and a knitting path 9*c* are also provided on the slider cam 7 which acts on the butt of the slider, respectively. Common portions of a plurality of paths are denoted with a solid line.

Figure 2:
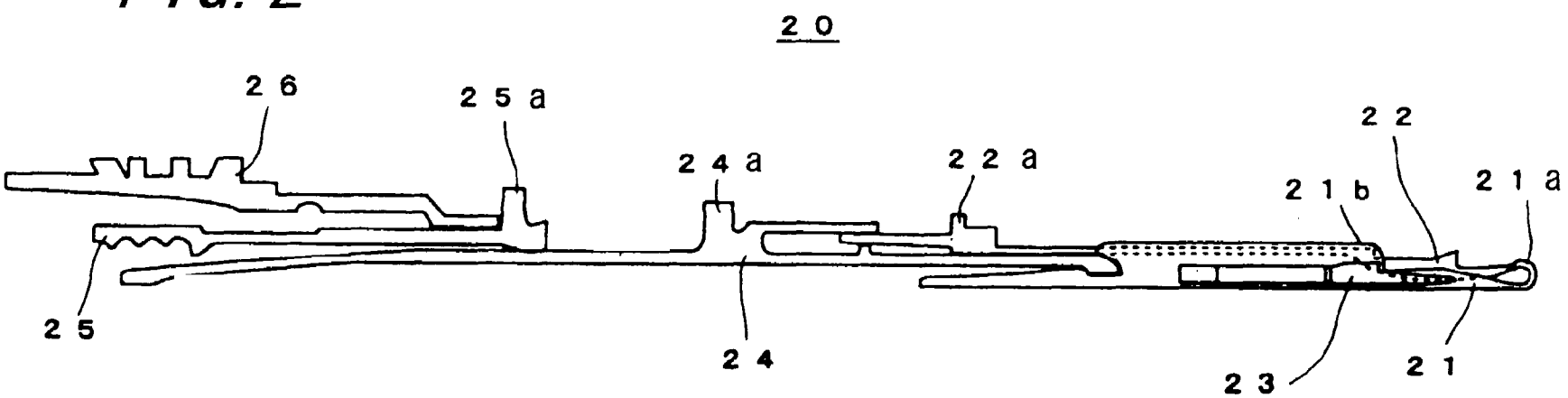
FIG. 2 is a side view illustrating a schematic configuration of a compound needle 20 which is driven by the complex cam system 1 of FIG. 1.

FIG. 2 shows a schematic configuration of a compound needle 20 which is driven by the complex cam system 1 of FIG. 1. The compound needle 20 as the knitting needle includes a needle body 21, a slider 22, a blade 23, a needle jack 24, a select jack 25, and a selector 26. The compound needle 20 is stored in the needle groove which is formed in each needle bed, and can be slid and displaced so that a portion from a hook 21*a* at a tip of the needle body to a step 21*b* thereof is advanced to the needle bed gap. In the compound needle 20, the slider 22 for opening and closing the hook 21*a* can be slid and displaced in the needle groove independent of the needle body 21. The blade 23 is provided on a side of the needle body in the vicinity of the step 21*b* of the needle body 21. The blade 23 is formed by a plate spring made of metal, and allows the hook 21*a* of the needle body 21 to be inserted from the opposed needle bed with respect to the needle bed gap. A butt 22*a* is provided on a base end side of the slider 22 to allow the butt 22*a* to project to an upper side of the needle groove. The needle jack 24 is connected on a base end side of the needle body 21, and a butt which is projected to an upper side of the needle groove is provided on the needle jack 24. The select jack 25 is disposed behind the needle jack 24, and a butt 25*a* is projected to an upper side from the needle groove. The selector 26 is disposed behind the needle jack 25.

Figure 3:
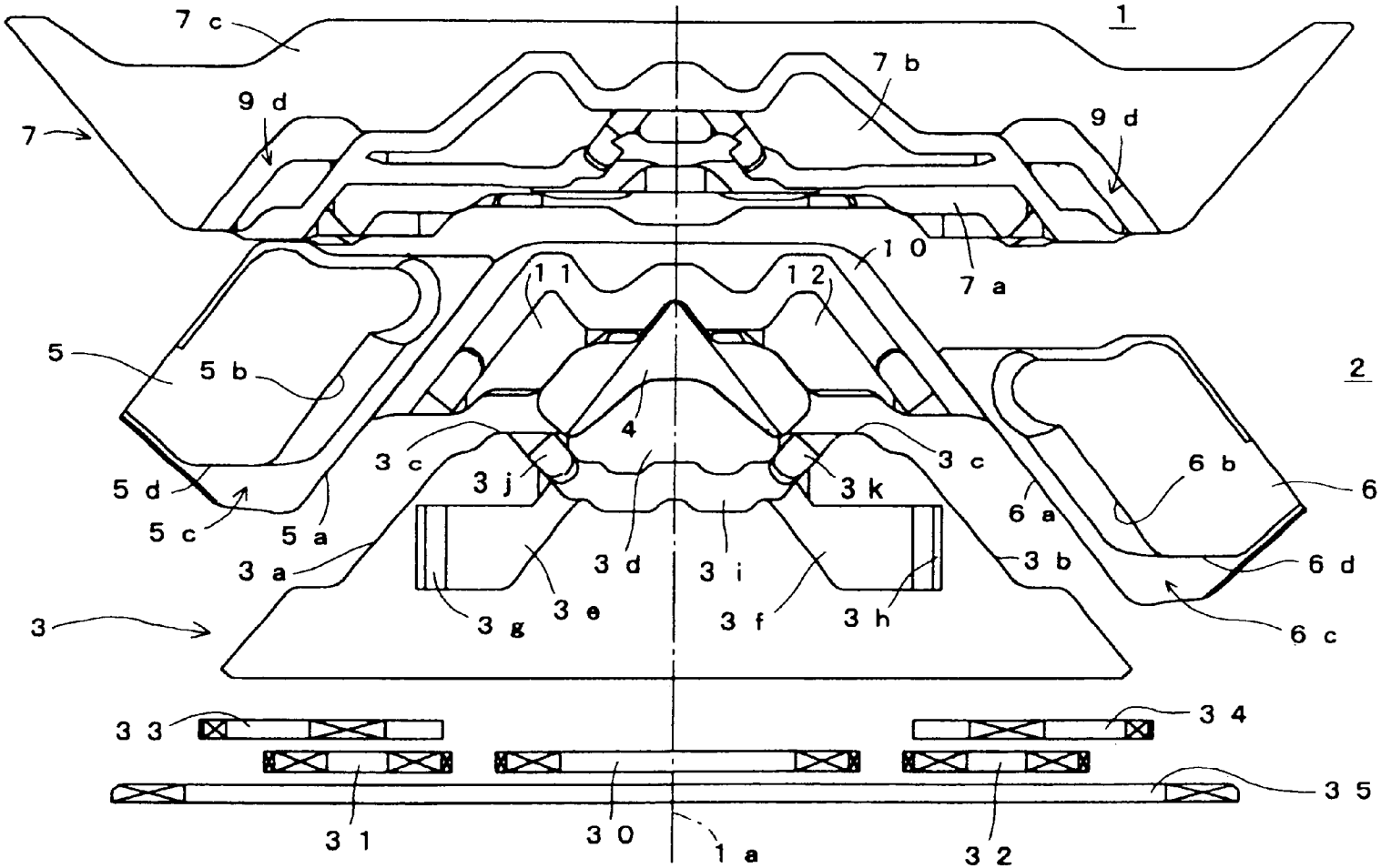
FIG. 3 is a plan view illustrating a configuration of a cam in the complex cam system 1 of FIG. 1.

FIG. 3 shows a configuration of a cam in the complex cam system 1 of FIG. 1. The needle raising cam 3 has a substantially trapezoidal shape, and when the butt 24*a* of the needle jack 24 which drives the needle body 21 along inclined surfaces 3*a* and 3*b* on both sides of the needle raising cam 3 is elevated, the hook 21*a* of the needle body 21 can be advanced to a tuck position in the needle bed gap at a position of a narrow side 3*c* having a step. A projecting portion 3*d* having a peak on the center line 1*a* is formed around a middle of the narrow side 3*c* of the needle raising cam 3. The projecting portion 3*d* can guide the butt 24*a* for driving the needle body 21 to project the hook 21*a* to the needle bed gap side so that the hook 21*a* of the needle body 21 reaches a knit position. The transfer cam 4 is provided on a needle bed gap side of the projecting portion 3*d*. The transfer cam 4 has a substantially triangular shape having a peak on the center line 1*a*, and guides the butt 24*a* for driving the needle body 21 by the inclined surfaces on both sides, to advance to a delivering position of transfer in the needle bed gap. A bottom portion of the transfer cam 4 has a dent in a form corresponding to a profile of the projecting portion 3*d* of the needle raising cam 3. The transfer cam 4 is a projection and retraction type, and in a state of retraction, an upper end of the profile of the projecting portion 3*d* in the needle raising cam 3 forms a peak portion of a path for knit in a knitting operation.

An upper side transfer guide cam 10 is provided on a needle bed gap side of the transfer cam 4. Lower side transfer guide cams 11 and 12 are provided on both sides of the transfer cam 4, respectively. Three knobby-shaped paths for guiding the butt 24*a* for driving the needle body 21 are formed between the upper side transfer guide cam 10 and the transfer cam 4 as well as the lower side transfer guide cams 11, 12. In the inclined surfaces 3*a* and 3*b* having a full height of the needle raising cam 3, concave portions 3*e* and 3*f* having a half height are formed and inclined surfaces 3*g* and 3*h* declined to the concave portions 3*e* and 3*f* are also provided. A groove 3*i* having a height equal to that of the bottom plate 2 is formed between the concave portions 3*e* and 3*f*. Slopes 3*j* and 3*k* are provided between the narrow side 3*c* and the groove 3*i*.

Inclined surfaces 5*a* and 6*a* which determine stitch density are provided in the knitting cams 5 and 6. Grooves are provided outside the inclined surfaces 5*a* and 6*a*, and inclined surfaces 5*b* and 6*b* are formed in parallel to the inclined surfaces 5*a* and 6*a* respectively, to guide the butt 24 for driving the needle body 21 on a receiving side. This guide path guides the butt 24*a* for driving the needle body 21 to guide surfaces 5*d* and 6*d* which is located on a lower side of the knitting cams 5 and 6, and on an upper side of a lower end through slopes 5*c* and 6*c*.

The slider cam 7 includes three portions, i.e., a lower slider guide cam 7*a*, a middle slider guide cam 7*b*, and an upper slider guide cam 7*c*. A path for guiding the butt 22*a* of the slider 22 in a knitting operation is formed between the lower slider guide cam 7*a* and the middle slider guide cam 7*b*. Divided from a middle of the path, a path for guiding the butt 22*a* of the slider 22 which is on a delivering side of transfer is formed between the middle slider guide cam 7*b* and the upper slider guide cam 7*c*. Note that, likewise with respect to JP-B2 6-84583, a path 9*d* for guiding the butt 22*a* of the slider 22 is also provided for increasing a stitch in addition to a normal transfer.

The paths for guiding the butts 24*a* and 22*a* of the needle body 21 and the slider 22 respectively are switched by projection and retraction switching of pressers 30, 31, 32, 33, 34, and 35, and the transfer cam 4. Respective pressers 30, 31, 32, 33, 34, and 35 act on the butt 25*a* of the select jack 25 which is provided on a base end side of the knitting needle, in accordance with a needle selecting position which is defined by a needle selecting operation for the selector 26. When needle selection is carried out so that the butt 25*a* of the select jack 25 is situated at positions of the presser 33 and 34, and the transfer cam 4 is projected and the pressers 33 and 34 on both sides thereof are retracted, the butt 24*a* of the needle body 21 can be guided by the delivering path 8*a* shown in FIG. 1. When the path of the butt 25*a* is the same and the transfer cam 4 is retracted, the butt 24*a* of the needle body 21 can be guided by the knitting path 8*c* for knit. When the presser 31 and 32 on both sides are projected and the presser 30 in the middle is retracted, the path of the presser 30 is switched so as to pass though the pressers 30, 31, and 32, and thereby the butt 24*a* of the needle body 21 can be guided by the receiving path 8*b*.

The pressers 33 and 34 on an upper side are provided in order to switch to the path 9*d* for increasing a stitch. The presser 35 on a lower side is a fixed type, and is provided so that respective butts 22*a* and 24*a* jump a cam to carry out a miss operation when the butt 25*a* passes through the presser 35.

Figure 4:
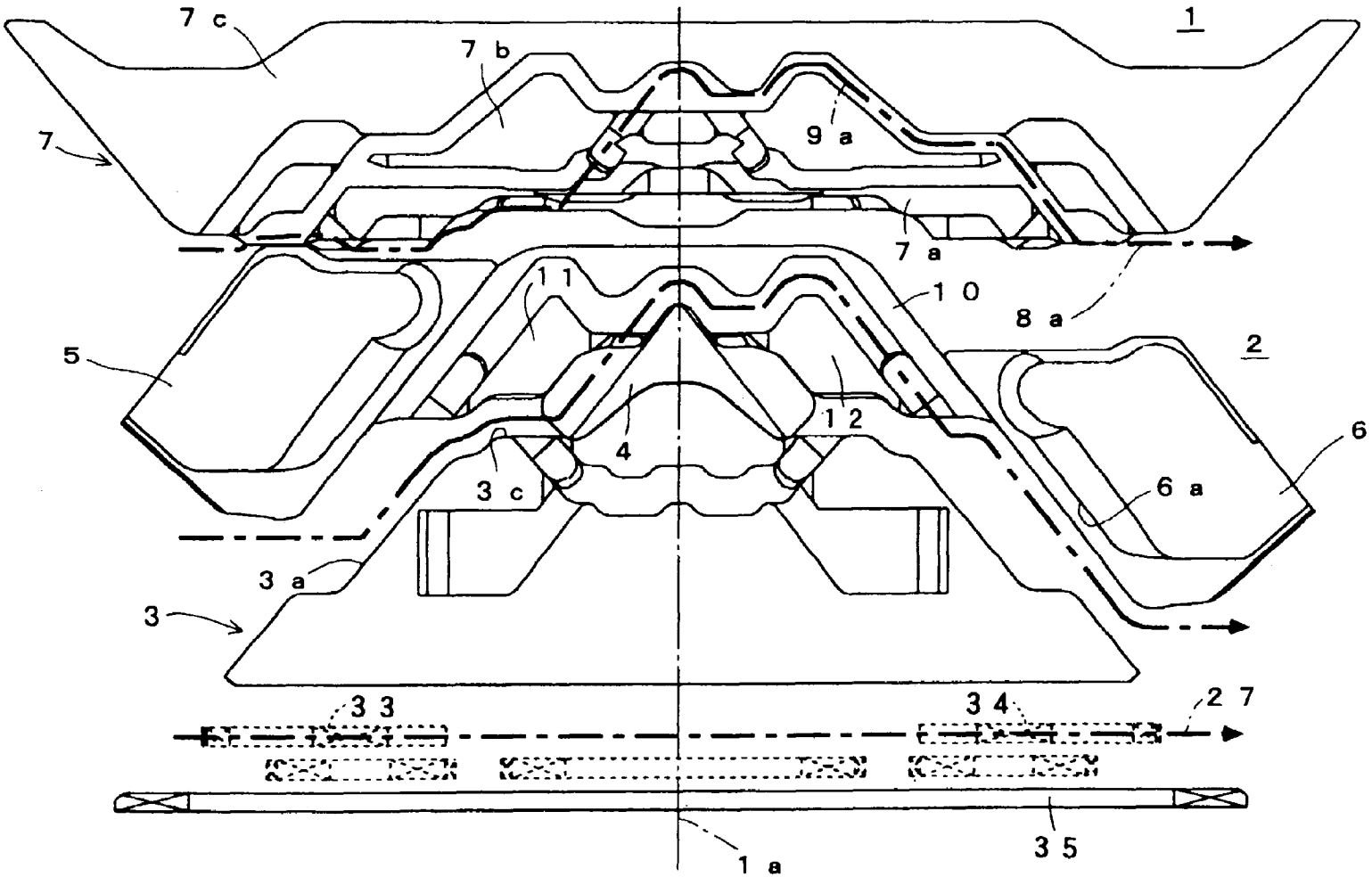
FIG. 4 is a plan view illustrating a state in which paths for guiding a butt 24*a* of a needle body 21 and a butt 22*a* of a slider 22 are switched to delivering paths 8*a* and 9*a*, in the complex cam system 1 of FIG. 1.

FIG. 4 shows a state in which paths for guiding the butt 24*a* of the needle body 21 and the butt 22*a* of the slider are switched to the delivering paths 8*a* and 9*a*, in the complex cam system 1 of FIG. 1. One of the needle beds opposed to each other across the needle bed gap is switched to the delivering paths 8*a* and 9*a*, and the other of the needle beds is switched to the receiving paths 8*b* and 9*b* shown in FIG. 5, and thereby a transfer operation is carried out. The butt 25*a* of the select jack 25 is guided to a path 27 which passes through the retracted pressers 33 and 34. The butt 24*a* for driving the needle body 21 is raised along the inclined surface 3*a* of the needle raising cam 3, and is further raised along an inclined surface of the transfer cam 4. Accordingly, the butt 22*a* of the slider 22 is also shifted from the lower slider guide cam 7*a* to a path between the middle slider guide cam 7*b* and the upper slider guide cam 7*c*. The butt 24*a* of the needle body 21 is situated at a projecting position of the first knob on the center line 1*a*, is declined along a bottom side of the upper side transfer guide cam 10, and is then raised for the second knob along an inclined surface of the lower side transfer guide cam 12 on a right side. The butt 22*a* of the slider 22 is also projected in a form of two knobs having the same phase as the needle body 21, in a path between the middle slider guide cam 7*b* and the upper slider guide cam 7*c*. The butt 24*a* of the needle body 21 is pulled down along the inclined surface 6*a* of the knitting cam 6. When the presser 34 which is situated on a downstream side of a moving direction is projected, the butt 22*a* can be guided to the path 9*d* for increasing a stitch shown in FIG. 3.

Figure 5:
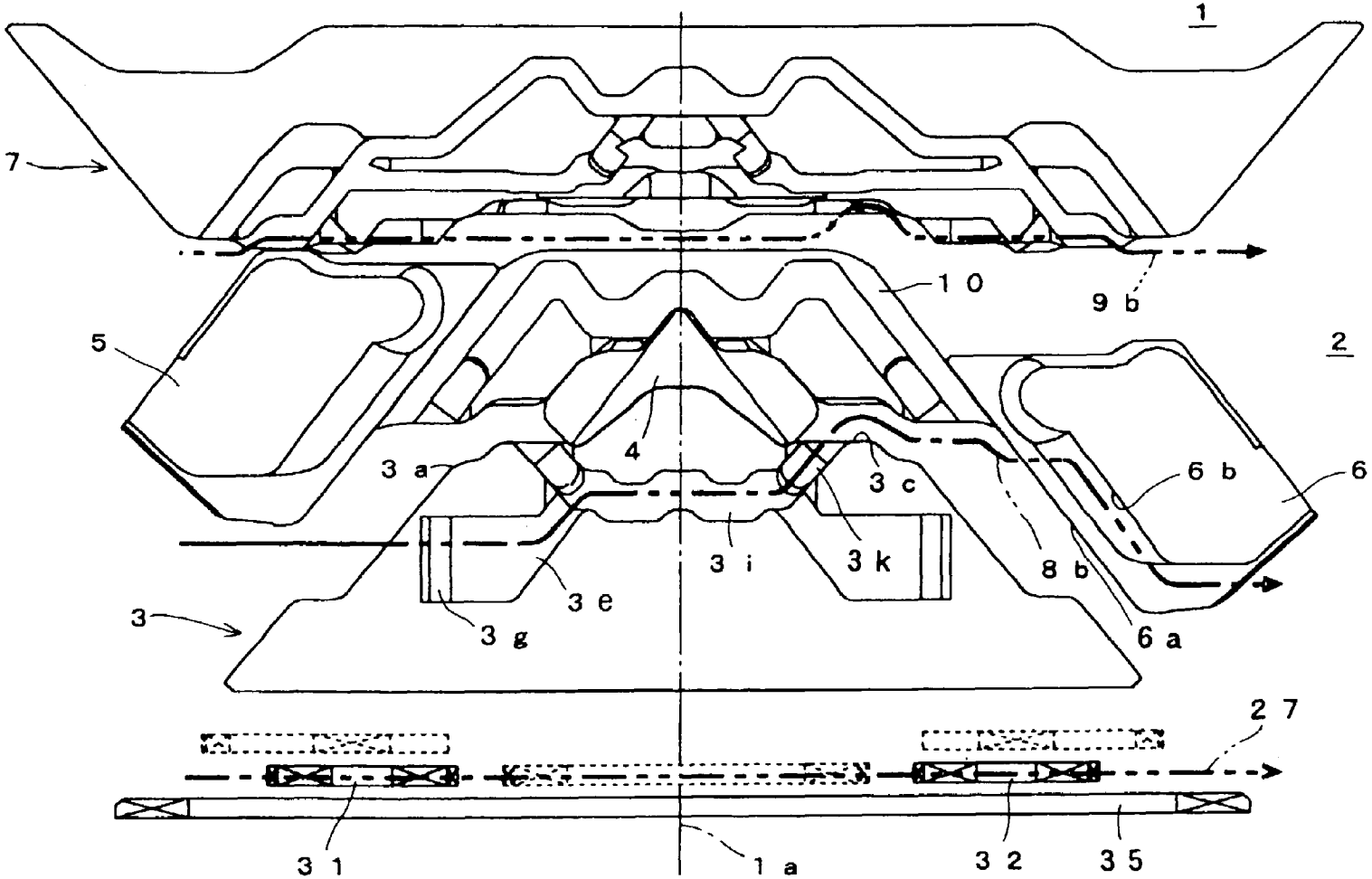
FIG. 5 is a plan view illustrating a state in which the paths for guiding the butt 24*a* of the needle body 21 and the butt 22*a* of the slider 22 are switched to delivering paths 8*b* and 9*b*, in the complex cam system 1 of FIG. 1.

FIG. 5 shows a state in which the paths for guiding the butt 24*a* of the needle body 21 and the butt 22*a* of the slider are switched to the delivering paths 8*b* and 9*b*, in the complex cam system 1 of FIG. 1. The butt 24*a* for driving the needle body 21 is guided so as to be retracted by an effect of the presser 31, get over the inclined surface 3*a* of the needle raising cam 3, and move from the slope 3*g* to the concave portion 3*e*. The butt 24*a* is raised along an inclined surface on a lower side of the concave portion 3*e*, enters the groove 3*i*, passes through the slope 3*k*, and reaches an upper side of the narrow side 3*c*. The butt 24*a* is moved at a height substantially corresponding to that of a tuck position, projects the presser 32, retracts the butt 25*a* of the select jack 25 and also retracts the butt 24*a* into the needle groove. Accordingly, the inclined surface 6*a* of the knitting cam 6 is jumped. The butt 24*a* is guided by the inclined surface 6*a* inside the knitting cam 6 to be pulled down. The butt 22*a* of the slider 22 passes through an upper side of the upper transfer guide cam 10 while the butt 25*a* of the select jack 25 is retracted into the needle groove by the presser 31 and passes through the concave portion 3*e*, and passes through a path in which the butt 22*a* is not raised to a position at which it receives an effect of the slider cam 7. However, there is a portion which is raised while the needle body 21 is raised.

Figure 6:
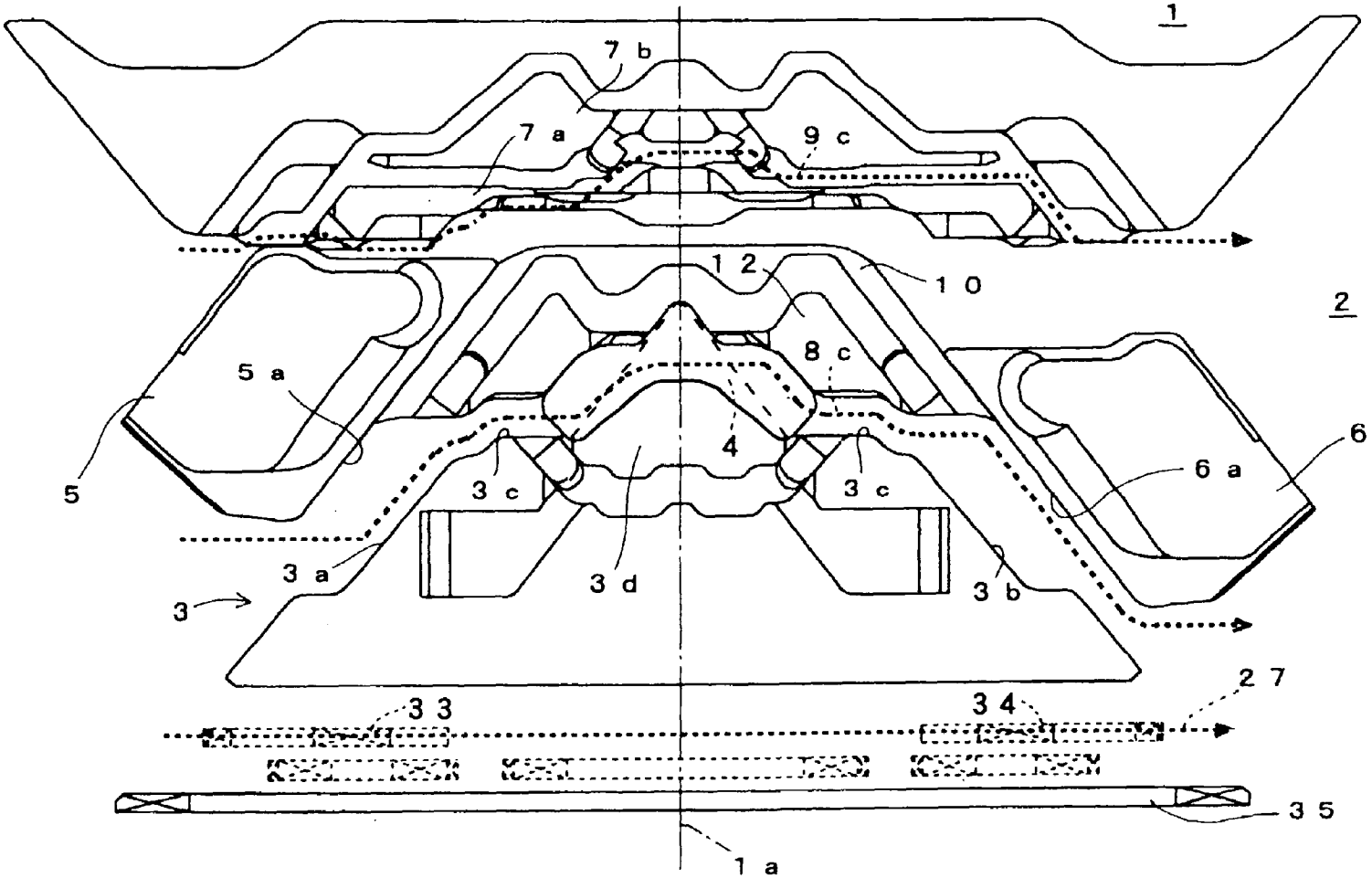
FIG. 6 is a plan view illustrating a state in which the paths for guiding the butt 24*a* of the needle body 21 and the butt 22*a* of the slider 22 are switched to delivering paths 8*c* and 9*c*, in the complex cam system 1 of FIG. 1.

FIG. 6 shows a state in which the paths for guiding the butt 24*a* of the needle body 21 and the butt 22*a* of the slider 22 are switched to the delivering paths 8*c* and 9*c*, in the complex cam system 1 of FIG. 1. The butt 24*a* for driving the needle body 21 is raised along the inclined surface 3*a* of the needle raising cam 3 and reaches a tuck position along the narrow side 3*c*. Thereafter, the butt 24*a* passes through the retracted transfer cam 4 and is raised to a knit position along an inclined surface of the projecting portion 3*d*. The butt 24*a* is guided along a bottom surface of the lower side transfer guide cam 12 and is pulled down by the inclined surface 6*a* of the knitting cam 6. The butt 22*a* of the slider 22 is raised while the butt 24*a* of the needle body 21 is raised to a knit position along an inclined surface of the upper side transfer guide cam 10, and is guided to a path between the lower slider guide cam 7*a* and the middle slider guide cam 7*b*.

Figure 7:
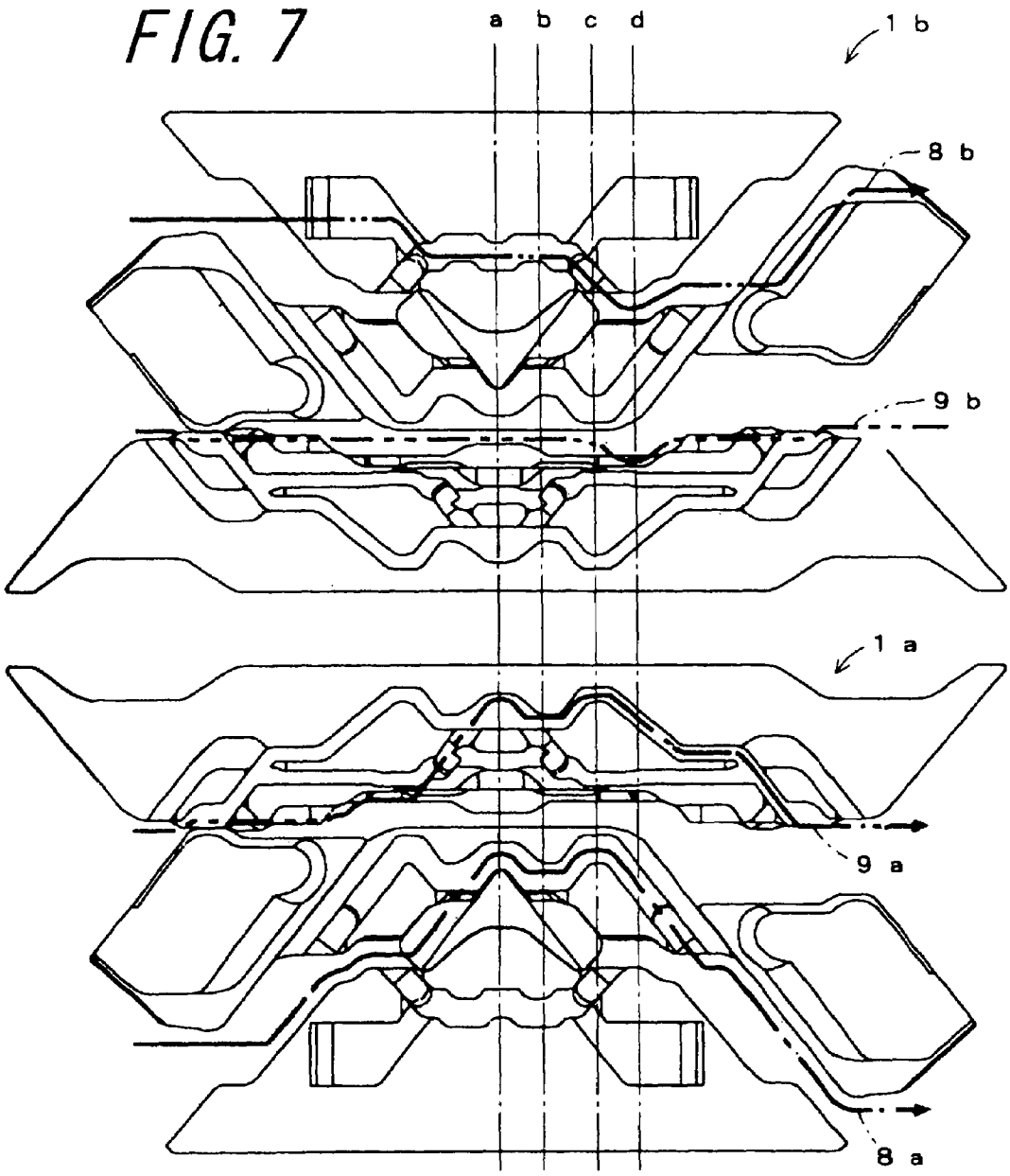
FIG. 7 is a plan view illustrating a corresponding relationship between a complex cam system on a delivering side 1*a* and a complex cam system on a receiving side 1*b;*

FIG. 7 shows a corresponding relationship between a complex cam system on a delivering side 1*a* and a complex cam system on a receiving side 1*b*. At a position of "a", projection for the first knob is carried out on a delivering side. At a position of "b", the needle body 21 is pulled in following the first projection. At a position of "c", projection for the second knob is carried out. Moreover, at a position of "c", the hook 21*a* on a receiving side is interposed into between the blade 23 on a delivering side and the needle body 21. At a position of "d", the needle body 21 on a delivering side is declined, and the hook 21*a* on a receiving side is further raised.

Figure 8A:
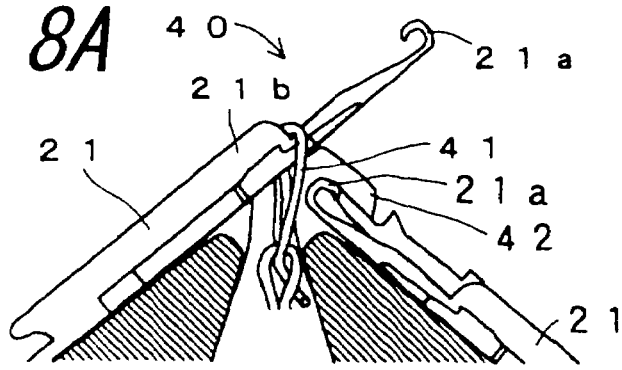
FIGS. 8A to 8D are sectional side views illustrating a state of transfer in a needle bed gap 40 corresponding to "a", "b", "c" and "d" of FIG. 7, respectively.
Figure 8B:
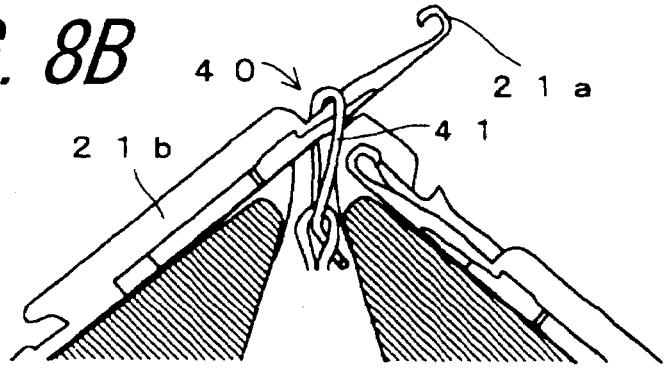
Figure 8C:
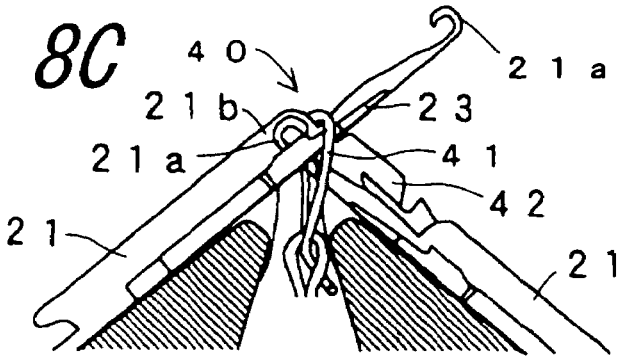
Figure 8D:
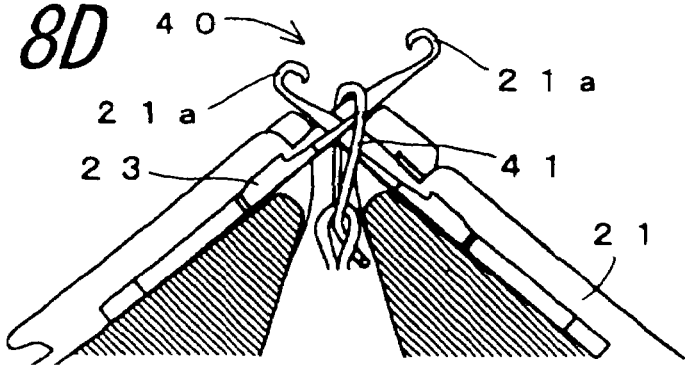

FIGS. 8A to 8D show states of transfer in the needle bed gap 40 corresponding to "a", "b", "c", and "d" of FIG. 7, respectively. In FIG. 8A, a knitted loop 41 to be transferred is locked at the step 21*b* of the needle body 21 on a delivering side. The hook 21*a* of the needle body 21 on a receiving side is not yet raised to a tip of a sinker 42. In FIG. 8B, the needle body 21 is slightly retracted from the needle bed gap 40 to produce a slack in the knitted loop 41. In FIG. 8C, the knitted loop 41 is once again hung on the step 21*b*. In FIG. 8C, the hook 21*a* on a receiving side is inserted to between the blade 23 and the needle body 21. At this time, a slack is produced in the knitted loop 41, allowing a smooth insertion. In FIG. 8D, the needle body 21 on a delivering side is slightly retracted from the needle bed gap 40, and the hook 21*a* of the needle body 21 on a receiving side is further raised.

Figure 9:
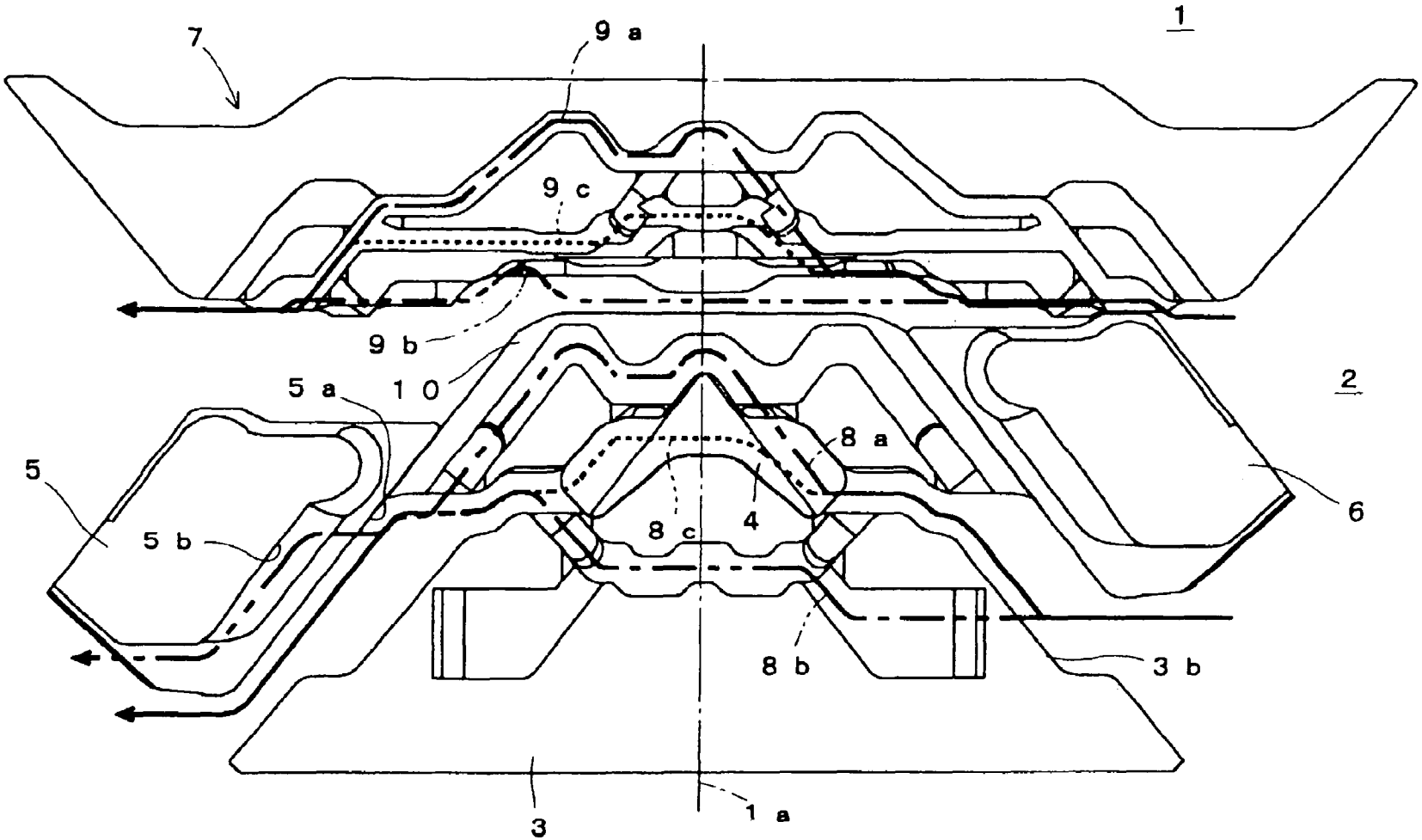
FIG. 9 is a plan view illustrating a guide path when a carriage moves to a right side in the complex cam system 1 of FIG. 1.

FIG. 9 shows a guide path when the carriage moves to a right side in the complex cam system 1 of FIG. 1. As the delivering paths 8*a* and 9*a* for transfer, two knobs on a left side in the three knobby-shaped paths can be used to carry out transfer, likewise with respect to FIGS. 1 to 7 and FIGS. 8A to 8D. In addition, instead of the compound needle 20, a latch needle can be also used as the knitting needle. When the latch needle is used, the slider cam 7 is not required. When the compound needle 20 is used, formation of an increased stitch can be also performed, likewise with respect to JP-B2 6-84583.

As described above, the complex cam system 1 is mounted on the carriage which reciprocatingly moves along a longitudinal direction of the needle beds opposed to each other across the needle bed gap 40 of the weft knitting machine. The needle raising cam 3, and a switching mechanism including the transfer cam 4 and the pressers 30, 31, 32, 33 and 34 are mounted on the complex cam system 1, in order to allow an operation for forming a knitted loop, and an operation for transfer between the needle beds opposed to each other, by reciprocatingly moving the knitting needle 20 disposed in each needle bed in a width direction of the needle bed so as to advance to the needle bed gap 40 and retract therefrom. The needle raising cam 3 guides the butt 24*a* of the knitting needle 20 along the knitting path 8*c* having a mountain-like shape symmetric with respect to the center line 1*a* extending through a tip of the needle raising cam 3 in a width direction of the needle bed so that the hook 21*a* of the knitting needle 20 can be advanced to a knit position in the needle bed gap 40 in both directions of reciprocating movement of the carriage. The transfer cams 4 are provided at a peak portion at which the knobby-shaped path having mountain-like shape for guiding the butt 24*a* of the knitting needle 20 corresponds to a knit position of the needle raising cam 3, and on both sides of the peak portion, respectively, so as to advance the hook 21*a* of the knitting needle 20 to a transfer position on a needle bed gap 40 side closer than a knit position, on the center line 1*a* of the needle raising cam 3. The switching mechanism shifts a guide path of the butt 24*a* of the knitting needle 20 to the knobby-shaped path in the middle of the transfer cam 4 while the butt 24 is raised by the needle raising cam 3, and further guides the butt 24*a* so that the butt 24*a* passes through the knobby-shaped path on a downstream side of a moving direction of the carriage. Accordingly, the switching mechanism allows the knitting needle 20 to carries out an operation on a knitted loop delivering side in transfer.

The path 8*b* for guiding the butt 24*a* of the knitting needle 20 on a knitted loop receiving side is provided so that the butt 24*a* of the knitting needle 20 on a knitted loop delivering side passes through the knobby-shaped path on the downstream side, and the hook 21*a* of the knitting needle 20 on a knitted loop receiving side receives the knitted loop 41 which is locked by the knitting needle 20. Accordingly, a transfer operation can be done. The knitting needle 20 on a knitted loop delivering side passes through the knobby-shaped path in the middle and the knobby-shaped path on the downstream side, and then delivers the knitted loop 41, thereby carrying out a delivering at a timing of two knobs so as to loosen the knitted loop using the two knobs to allow a stable transfer. The path of the first knob utilizes halfway a rising path of the needle raising cam 3 for knitting a knitting fabric, shears the rising path, and separates a declining path, to prevent the carriage from increasing in size.

Further, the transfer cam 4 forms the knobby-shaped path in the middle and the knobby-shaped paths provided on both sides of the burn-shaped path in the middle, on a center line 1*a* side closer than the knitting cams 5 and 6, and the guide path 8*b* for guiding the butt 24*a* of the knitting needle 20 on a knitted loop receiving side is provided in an internal area of the needle raising cam 3. Therefore, it is not necessary to provide a path outside the knitting cams 5 and 6, preventing the carriage from increasing in size.

Further, the needle raising cam 3 has the narrow side 3*c* which is a step as a path zone for keeping a state in which the knitting needle 20 advances to a tuck position in the needle bed gap 40, and the knobby-shaped paths on both sides of the transfer cam 4 are formed on a needle bed gap 40 side of the step. Therefore, a width of the transfer cam 4 can be limited to be narrow. Moreover, switching to an operation for transfer is carried out by guiding the butt 24 from a state in which the butt 24 of the knitting needle 20 is guided to the step along the path of the needle raising cam 3, to the knobby-shaped path in the middle formed by projection of the transfer cam 4. Therefore, a path for raising the knitting needle 20 to a tuck position by the needle raising cam 3 can be also used for a transfer operation, preventing the carriage from increasing in size.

Further, the knitting needle is a compound needle which have the needle body having the hook 21*a* at a tip thereof, and the slider 22 for opening and closing the hook 21*a*, and the needle raising cam 3 and the transfer cam 4 guide the butt 24*a* of the needle body 21 to allow a knitting operation and a transfer operation. The butt 22*a* of the slider 22 is guided by the slider cam 7 along the three knobby-shaped paths having the same phase as the knobby-shaped path in the middle of the transfer cam and the knobby-shaped paths on both sides thereof, allowing a smooth transfer operation as the compound needle 20.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, knobby-shaped paths for driving a butt of a knitting needle to project a hook to a needle bed gap are provided in a transfer cam at a peak portion corresponding to a knit position of a needle raising cam, and on both sides of the peak portion, respectively. A switching mechanism shifts a guide path of the butt of the knitting needle to the knobby-shaped path in a middle of the transfer cam while the butt is raised by the needle raising cam, and further guides the butt so that the butt passes through the knobby-shaped path on a downstream side of a moving direction of a carriage. The knitting needle for a knitted loop delivering is projected to the needle bed gap using two knobs in the three knobby-shaped paths. Therefore, a knitted loop delivering can be carried out at a timing of two knobs to carry out a smooth transfer. The path of the first knob becomes common between a knitting operation and a transfer operation when rising, and becomes separated therebetween when declining. Therefore, a rising path of the needle raising cam for knitting a knitting fabric can be used halfway, thereby preventing the carriage from increasing in size.

Further, according to the invention, the transfer cam includes the three knobby-shaped paths for guiding the butt of the knitting needle on a knitted loop delivering side, on an inside of the knitting cam, and a path for guiding the knitting needle on a knitted loop receiving side is also provided on an inside of the knitting cam. Therefore, it is not necessary to provide a path on an outside of the knitting cam, preventing the carriage from increasing in size.

Further, according to the invention, the needle raising cam has a step as a path zone for keeping a state in which the knitting needle advances to a tuck position in the needle bed gap, and the knobby-shaped paths on both sides of the transfer cam are formed on a needle bed gap side of the step. Therefore, a width of the transfer cam can be limited to be narrow. Moreover, a path for raising the knitting needle to a tuck position by the needle raising cam 3 can be also used for a transfer operation, preventing the carriage from increasing in size.

Further, in the invention, similarly when a compound needle is used as the knitting needle, the needle raising cam and the transfer cam can guide the butt of a needle body to allow a knitting operation and a transfer operation. The butt of the slider can be guided by a slider cam along three knobby-shaped paths having the same phase as the knobby-shaped path in the middle of the transfer cam and the knobby-shaped paths on both sides thereof, allowing a smooth transfer operation as the compound needle.

The invention claimed is:

1. A complex cam system mounted on a carriage which reciprocatingly moves along a longitudinal direction of needle beds opposed to each other across a needle bed gap of a weft knitting machine, for reciprocatingly driving knitting needles disposed in each of the needle beds in a width direction of the needle beds so as to advance and retract the knitting needles and allowing the knitting needles to carry out an operation for forming a knitted loop, and as well to carry out an operation for transfer between the needle beds, comprising:

a needle raising cam for guiding a butt of the knitting needle along a path having a mountain-like shape portion symmetric with respect to a center line passing through a peak portion thereof and extending in the advancing and retracting direction of the knitting needle so that a hook of the knitting needle can advance to a knit position in the needle bed gap in both directions of reciprocating movement of the carriage; and a transfer cam in which mountain-like knobby-shaped paths for guiding the butt of the knitting needle are provided at a peak portion corresponding to the knit position of the needle raising cam, and on both sides of the peak portion, respectively, so that the hook of the knitting needle advances to a transfer position on a needle bed gap side closer than the knit position on the center line, wherein in a transfer operation, a guide path of the butt of the knitting needle on a knitted loop delivering side is shifted to the knobby-shaped path in a middle of the transfer cam while being raised by the needle raising cam, and is further guided so as to pass through a bump-shaped path on a downstream side of a moving direction of the carriage, and a guide path of the knitting needle on a knitted loop receiving side is guided so that the butt of the knitting needle on the knitted loop delivering side passes through the knobby-shaped path on a downstream side, and then the knitted loop locked by the knitting needle is received by the hook of the knitting needle on the knitted loop receiving side.

2. The complex cam system of claim 1, wherein the knobby-shaped path in a middle of the transfer cam and the knobby-shaped paths provided on both sides of the knobby shaped path in the middle of the transfer cam are disposed to be closer to the center line side closer than a knitting cam which guides along a path for pulling down the butt of the knitting needle from the needle bed gap so that the hook of the knitting needle is retracted from the needle bed gap in a knitting operation, and the guide path which guides the butt of the knitting needle on the knitted loop receiving side is also disposed to be closer to the center line side than the knitting cam.

3. The complex cam system of claim 1, wherein the needle raising cam includes, in a mountain-like shape portion of the path, a step which becomes a path zone for keeping a state in which the knitting needle advances to a tuck position in the needle bed gap, the knobby-shaped paths on both sides of the transfer cam are formed on a needle bed gap side of the step, and the switching mechanism carries out switching to the operation for the transfer by guiding the butt of the knitting needle from a state guided to the step along the path of the needle raising cam to the knobby-shaped path in the middle of the transfer cam.

4. The complex cam system of claim 1, wherein the knitting needle is a compound needle which has a needle body having the hook at a tip thereof and a slider for opening and closing the hook, the needle raising cam and the transfer cam guide the butt of the needle body, and the transfer cam system further comprises a slider cam for guiding a butt of the slider in three knobby-shaped paths having the same phase as the knobby-shaped path in the middle of the transfer cam and the knobby-shaped paths on both sides thereof.

5. The complex cam system of claim 2, wherein the knitting needle is a compound needle which has a needle body having the hook at a tip thereof and a slider for opening and closing the hook, the needle raising cam and the transfer cam guide the butt of the needle body, and the transfer cam system further comprises a slider cam for guiding a butt of the slider in three knobby-shaped paths having the same phase as the knobby-shaped path in the middle of the transfer cam and the knobby-shaped paths on both sides thereof.

6. The complex cam system of claim 3, wherein the knitting needle is a compound needle which has a needle body having the hook at a tip thereof and a slider for opening and closing the hook, the needle raising cam and the transfer cam guide the butt of the needle body, and the transfer cam system further comprises a slider cam for guiding a butt of the slider in three knobby-shaped paths having the same phase as the knobby-shaped path in the middle of the transfer cam and the knobby-shaped paths on both sides thereof.

7. A complex cam system mounted on a carriage of weft knitting machine for reciprocatingly driving knitting needles disposed in needle beds, the knitting needles being useable to form a knitted loop, comprising:

a needle raising cam to guide a butt of the knitting needles along a path having a mountain-like shape portion symmetric with respect to a center line passing through a peak portion thereof to advance a hook of the knitting needle;

a transfer cam in which a mountain-like knobby-shaped path that guides the butt of the knitting needles is provided at a peak portion corresponding to a knit position of the needle raising cam, to advance a hook of the knitting needle to a transfer position on a needle bed gap side closer than a knit position on a center line; and a transfer cam in which mountain-like knobby-shaped paths that guide the butt of the knitting needles is provided on both sides of the peak portion, respectively, to advance a hook of the knitting needle to a transfer position on a needle bed gap side closer than a knit position on a center line, wherein a first guide path, located along a knitted loop delivering side adjacent to the transfer cam, is shifted to the knobby-shaped path in the middle of the transfer cam while being raised by the needle raising cam, a second guide path, located along a knitted loop receiving side below a knitted path, is guided so that the butt of the knitting needle on the knitted loop delivering side passes through the knobby-shaped path on a downstream side.

8. The complex cam of claim 7, wherein a first knobby-shaped path provided in a middle of the transfer cam, a second knobby-shaped path, provided on one side of the first knobby-shaped path in the middle of the transfer cam, and a third knobby-shaped path, provided on the other side of the first knobby-shaped path in the middle of the transfer cam, are disposed to be closer to the center line side closer than a knitting cam which guides along a path for pulling down the butt of the knitting needle from the needle bed gap so that the hook of the knitting needle is retracted from the needle bed gap in a knitting operation, and wherein, the first guide path, which guides the butt of the knitting needle on the knitted loop receiving side, is also disposed to be closer to the center line side than the knitting cam.

* * * * *